US006764350B2

(12) United States Patent
Kosmala

(10) Patent No.: US 6,764,350 B2
(45) Date of Patent: Jul. 20, 2004

(54) CONNECTOR CONTACT RETENTION

(75) Inventor: Michael Lawrence Kosmala, Mission Viejo, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 56 days.

(21) Appl. No.: 10/128,915

(22) Filed: Apr. 23, 2002

(65) Prior Publication Data

US 2003/0199205 A1 Oct. 23, 2003

(51) Int. Cl.[7] ..... H01R 13/514

(52) U.S. Cl. ..... 439/752; 439/610; 439/599; 439/695; 439/598

(58) Field of Search ..... 439/598, 610, 439/701, 752, 695, 599, 747

(56) References Cited

U.S. PATENT DOCUMENTS

| | | | | |
|---|---|---|---|---|
| 3,158,424 A | | 11/1964 | Bowen | 339/217 |
| 3,402,382 A | | 9/1968 | De Tar | 339/103 |
| 3,475,720 A | | 10/1969 | Culver | 339/217 |
| 3,560,910 A | | 2/1971 | Sosinski | 339/217 |
| 3,697,935 A | | 10/1972 | Drapkin | 339/217 |
| 4,421,378 A | | 12/1983 | Sanford et al. | 339/217 |
| 4,655,525 A | * | 4/1987 | Hunt et al. | 439/599 |
| 4,698,030 A | * | 10/1987 | Ryll et al. | 439/752 |
| 4,834,678 A | | 5/1989 | Emandi et al. | 439/701 |
| 5,021,012 A | * | 6/1991 | Shibano | 439/610 |
| 5,104,342 A | * | 4/1992 | Liu et al. | 439/695 |
| 5,362,258 A | * | 11/1994 | Arnswald et al. | 439/695 |
| 5,575,691 A | | 11/1996 | Matthews | 439/744 |
| 5,643,016 A | | 7/1997 | Huss, Jr. | 439/744 |
| 5,957,732 A | | 9/1999 | Ito et al. | 439/752 |
| 6,116,945 A | * | 9/2000 | Davis et al. | 439/462 |

* cited by examiner

*Primary Examiner*—Tho D. Ta
(74) *Attorney, Agent, or Firm*—Roger C. Turner

(57) ABSTRACT

Contacts (12) that are terminated to the front ends of wires (22) are rapidly mounted in a connector shell (20) while assuring reliable separation of the contacts. After each contact is terminated to the front end of a wire, the contact is laid in a slot (60) of an insulative retainer (50). The retainer is then inserted forwardly between top and bottom arms (70, 72) of the rear portion (64) of an insulative body, while the contacts project into passages (14) in the front portion of the body. The assembly of retainer and body is inserted into the shell (20) that has a cylindrical inner surface (110) that radially positions the retainer between the arms of the body. A crimp barrel (122) is moved forwardly into the shell to about the rear of the retainer, a braiding (34) of a cable that contains the wires is folded back around the crimp barrel, and the rear portion (120) of the shell is crimped around the braiding and crimp barrel.

11 Claims, 3 Drawing Sheets

30
122
34
22
24
42
40
12
82
R
L
U
D
F
10
50
54
104
60
52
74
70
62
72
64
106
16
80
M
14
120
110
20
24
26
34
22
36
32
30
10
20
12
16
14

CONNECTOR CONTACT RETENTION

BACKGROUND OF THE INVENTION

One type of connector is assembled by terminating the front ends of wires to contacts and inserting the contacts into passages of an insulator, until retainer clips lock the contacts in place. The space taken up by the clips increases the required spacing between the passages, because metallic clips must be spaced to prevent arcing, and the presence of clips adds complication. A connector that could be easily assembled and that avoided the need for retainer clips would be of value.

SUMMARY OF THE INVENTION

In accordance with one embodiment of the present invention, a connector is provided with a plurality of contacts, which reliably holds the contacts apart to prevent arcing at moderately high voltages (e.g. 1000 volts) and which enables easy and reliable assembly. The connector includes an insulative retainer with front and rear ends and a plurality of slots extending between the ends. The contacts have rear ends soldered or otherwise terminated to conductors of wires, and the rear portions of the contacts and trailing portions of the wires are each inserted into one of the slots. An insulative body has a rear portion with top and bottom arms that form a cavity between them, the body also having a front portion with a plurality of passages. The retainer with contacts therein is inserted into the cavity while front ends of the contacts are inserted into the passages of the body. Thereafter, the assembly of the body and retainer is inserted into a shell that has a cylindrical portion that closely surrounds the arms and retainer to hold them in position.

After the retainer, body, and shell are assembled, a crimp barrel is moved around the cable that holds the wires, so a front end of the crimp barrel lies adjacent to the rear end of the body and retainer and the cable shield is wrapped backward around the barrel. As the shell is moved rearwardly around the body and retainer, a rear shell portion receives the crimp barrel and the shell rear portion is crimped to lock a jacket portion of the cable between the shell and crimp barrel.

The novel features of the invention are set forth with particularity in the appended claims. The invention will be best understood from the following description when read in conjunction with the accompanying drawings.

DESCRIPTION OF THE PREFERRED EMBODIMENTS

Figures 1, 2:
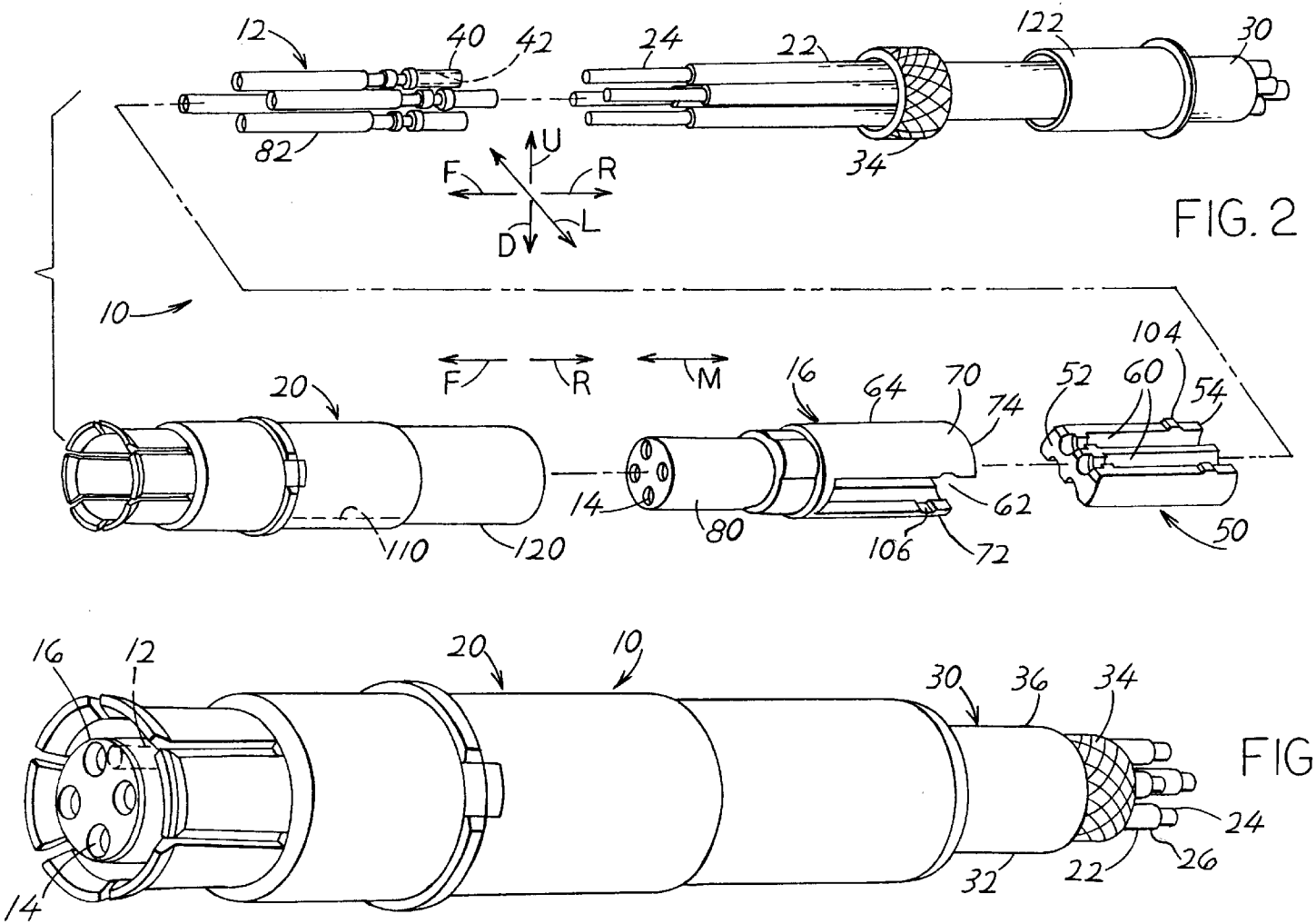
FIG. 1 is a front and side isometric view of a fully assembled connector constructed in accordance with the present invention.
FIG. 2 is an exploded isometric view showing the parts of the connector of FIG. 1.

FIG. 1 illustrates a fully assembled connector 10 of the invention, which includes four contacts that lie in four corresponding passages 14 in an insulative body 16. The body is surrounded by a metal shell 20. The contacts are each connected to a corresponding one of four wires 22 that each includes a wire conductor 24 surrounded by a wire insulation 26. The four wires are part of a cable 30 that also includes a jacket assembly 32 having a metal shield 34 that is usually in the form of a braiding and having an outer covering 36 around the braiding.

FIG. 2 shows the parts of the connector 10, including the insulative body 16 and the contacts 12 that are terminated to the wires 22 of the cable 30. Each of the contacts 12 has a rear portion 40 with a bore 42 therein that receives the bared conductor 24 of one of the wires 22. The conductor can be fixed in the contact as by soldering or crimping. The mounting of the contacts 12 in the passages 14 of the insulative body 16 to prevent rearward pull out, has commonly been accomplished by the use of clips with resilient tines that engage shoulders on the contacts. Where such clips are formed of metal for reliability, they must be individually installed, with a larger hole in the insulator to accommodate the clips, and resulting in a greater number of miniature parts and the need for greater spacing between the axes of the passages of the insulator.

In accordance with one feature of the present invention, applicant provides a retainer 50 for retaining the contacts 12 in the body 16. The retainer has front and rear ends 52, 54 and has four slots 60 that each extends in longitudinal M or front end rear F, R directions between its opposite ends. Each of the contacts 12, with a wire 22 trailing from it, can be mounted in one, of the slots 60. The retainer 50 then can be inserted into a cavity 62 in a rear portion 64 of the body. The body rear portion has top and bottom arms 70, 72 with front ends joined together and free rear ends 74. The insulator has a front portion 80 that forms the passages 14. When the retainer 50 is fully inserted into the cavity 62, the slots 60 are aligned with the passages 14. As a result, the contact front ends 82 are inserted into the passages 14 in the insulator front portion as the retainer 50 is inserted into the cavity 62.

Figure 4:
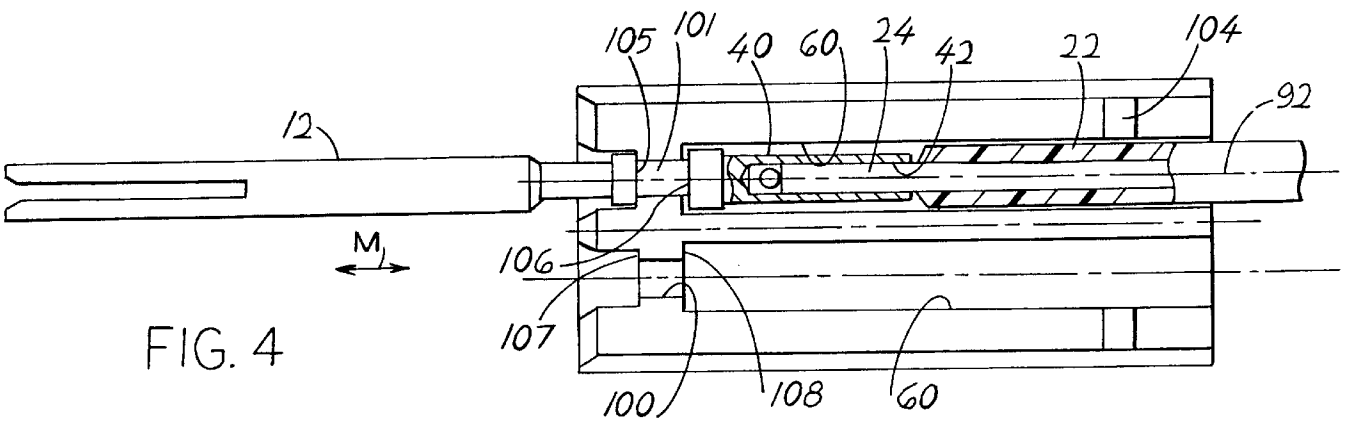
FIG. 4 is plan view of the retainer of FIG. 2, with a contact and wire lying in one slot of the retainer and with portions of the contact and wire shown in section.
Figure 6:
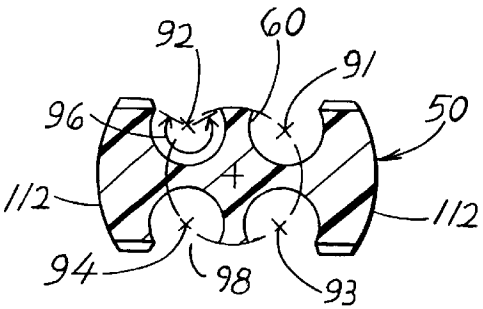
FIG. 6 is a view taken on line 6—6 of FIG. 5.

FIG. 6 shows a cross-section of the contact retainer 50. Each of the slots 60 has an axis 91–94, and the walls of each slot extends by an angle 96 of about 300° about its axis. This results in an undercut slot 98 which can retain a wire and contact inserted therein. The angle 96 is preferably at least 220° and is less than 360°. This results in insulation lying between contacts in adjacent slots, such as those with axes 91 and 92, to avoid arcing, as well as in mechanically retaining the wires and possibly the contacts in the slots. As shown in FIG. 4, a wire 22 is prepared by stripping off the insulation so as to leave a bared wire conductor 24 which can be inserted into a bore 42 at the rear of a contact 12, the wire then being crimped or soldered in place, applicant preferring to solder. The contact 12 with the wire 22 trailing behind it is inserted into a slot 60 by merely pressing the contact and wire into the slot in a direction perpendicular to the slot axis (e.g. 92). The retainer is formed of molded plastic and opposite sides of the slot walls can deflect apart slightly to insert the contact into the slot. Both the slot walls and the wire insulation can deform slightly while the length of the insulative wire is pressed into the slot.

Each slot extends along the full length of the retainer. It would be possible to form a 360° hole at the front end of each slot and insert each contact through such a hole. However, this is not necessary.

The undercut slot holds the contact and wire in position in the retainer. It is noted that the retainer has a neck at 100 that receives a corresponding neck 101 on the contact, to fix the longitudinal M position of the contact with respect to the retainer. The contact neck forms front and rear shoulders 105, 106 that engage corresponding shoulder 107, 108 formed at ends of the retainer slot neck.

Figure 7:
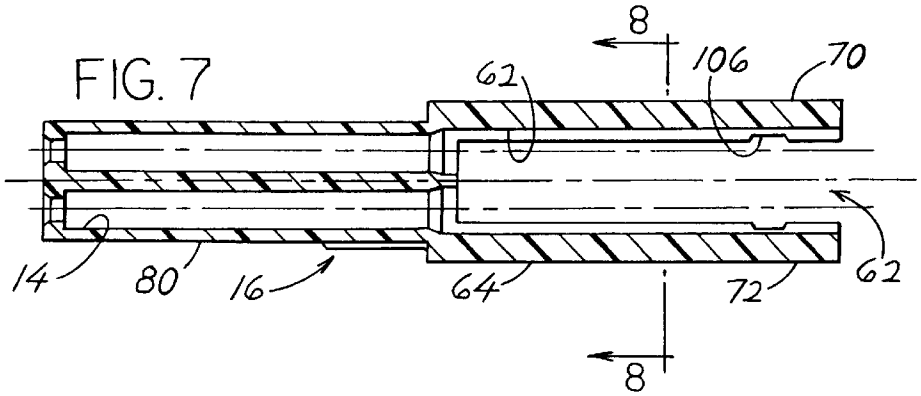
FIG. 7 is a sectional side view of the insulative body of the connector of FIG. 2.
Figure 5:
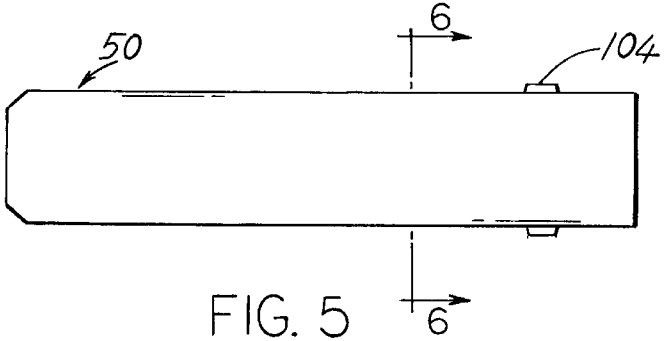
FIG. 5 is a side elevation view of the retainer of FIG. 4.

When the four contacts with trailing wires have been inserted into the retainer, the retainer is moved forward into the cavity 62 of the body 16. The retainer has four latch locations with projections 104 at each location. The body 15 shown in FIGS. 2 and 7, has four corresponding latch locations with notches 106 thereat. Accordingly, when the retainer has been fully forwardly inserted into the body rear portion, the retainer is latched in position by notches 106 receiving the projections 104.

Figure 3:
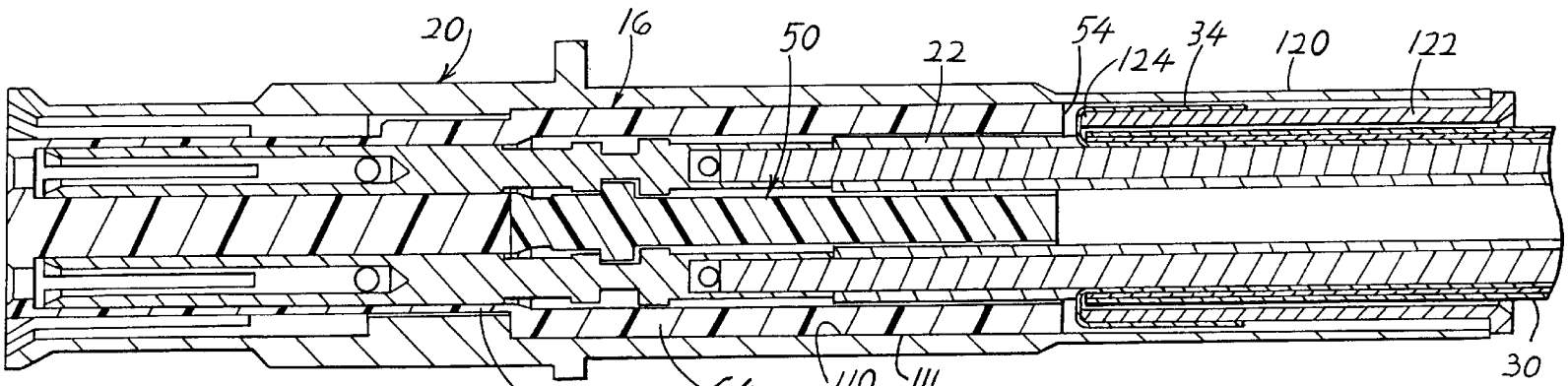
FIG. 3 is a sectional side view of the assembled connector of FIG. 1.
Figure 8:
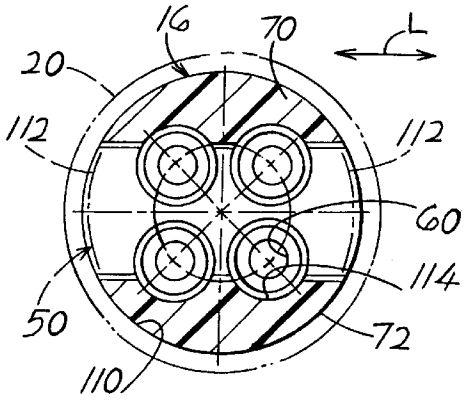
FIG. 8 is rear elevation view, taken on line 8—8, of the body of FIG. 7, and showing the retainer and shell in phantom lines.

As shown in FIG. 3, when the body 16 is inserted into the metal shell 20, the body rear portion 64 with the retainer 50 therein lies within the shell. The shell has a cylindrical inside surface 110 that closely surrounds the outer surface 111 of the arms of the body rear portions 64 and the outer surfaces of the retainer 50. As indicated in FIG. 8, the shell 20 not only keeps the top and bottom arms 70, 72 of the body together so they grip the retainer 50, but also prevent lateral L movement of the retainer with respect to the body. The retainer has laterally opposite sides 112 that lie on the imaginary cylinder of the shell inside surface 110. The rear body portion has body slot walls 114 that close the slots 60 of the retainer, so the insulation surrounds each contact by 360°.

To complete the assembly of the connector with the cable, a rear portion 120 of the shell, shown in FIG. 3, is crimped around a crimp barrel 122. The crimp barrel 122 has been threaded around the cable 30, and the cable shield in the form of the braiding 34 has been wrapped rearwardly around the front of the crimp barrel. As the retainer 50 and body 16 are inserted into the shell, the crimp barrel 122 is also inserted into the shell, until it lies in the shell rear portion 120 as is illustrated. The shell rear portion is then crimped around the barrel, with the braiding 34 locked between the shell and barrel as a result of the crimping. This provides a secure electrical and mechanical connection of the barrel and cable 30 to the shell. The front end 124 of the barrel substantially abuts the body and retainer.

Both the retainer 50 and body 16 are molded of plastic that is moderately stiff but not rigid, in that it can be resiliently deformed slightly when pressure is applied. Instead of forming the body rear portion with a pair of cantilevered arms, it is possible to form the body rear portion with a cavity that is enclosed at the top, bottom and opposite sides. However, the shell could not then readily clamp the body rear portion as tightly around the retainer as when the body rear portion has cantilevered arms.

While terms such as "top", "bottom", etc. have been used to describe the connector as it is illustrated, it should be understood that the connector can be used in any orientation with respect to the Earth.

Thus, the invention provides a connector with contacts terminated to wires, wherein the contacts are easily mounted in the connector without requiring clips to hold them in place. Rear portions of the contacts and front portions of the wires are installed in slots of a retainer that are open along most or all of the length of each slot for easy placement. The retainer is then moved forwardly into a cavity in the rear portion of the insulative body, while forward ends of the contacts move into passages at the front portion of the body that completely surround each of the contacts. The body with the retainer, contacts, and wire trailing portions in place, is inserted into a metal shell. A crimp barrel around which a braiding of the cable has been back-wrapped, is inserted into the rear of the shell as the body is inserted therein. The rear portion of the shell is then crimped around the crimp barrel and the back-wrapped braiding portion and outer jacket to provide a mechanical and electrical connection between the crimp barrel and cable and the shell.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector comprising:

an insulative retainer that has longitudinally-spaced front and rear ends and a plurality of slots that each extends between said ends;

an insulative body that has front and rear portions, said rear portion having longitudinally-extending top and bottom arms and a rearwardly-opening cavity between them into which said retainer fits, and said body front portion having a plurality of separate longitudinally-extending through passages that are aligned with said slots of said retainer when said retainer lies in said cavity;

a shell that surrounds said body;

said top and bottom arms can flex toward and away from each other, and said shell closely surrounds said body rear portion to hold said arms closely around said retainer.

2. The connector described in claim 1 wherein:

said retainer has a plurality of latch locations and said arms have a plurality of corresponding latch locations, with a projection and a projection-receiving notch at each pair of locations, one on said retainer and one on one of said arms, that prevent rearward movement of said retainer out of said cavity.

3. The connector described in claim 1 wherein:

each of said slots in said retainer has a slot axis and extends at least 200° but less than 360° about said slot axis to form an undercut slot.

4. The connector described in claim 1 including:

a plurality of contacts each having a rear portion lying in one of said slots;

each of said slots in said retainer has at least a forwardly-facing retainer shoulder and each of said contact rear portions has a rearwardly-facing shoulder abutting one of said retainer shoulders.

5. The connector described in claim 1 wherein:

each of said slots has an axis and has an opening that extends along the longitudinal length of the slot and that opens radially outward of the slot, and said arms have surfaces that cover said openings in said slots.

6. The connector described in claim 5 wherein:

said shell has an inside surface that surrounds said arms and said retainer and that lies on an imaginary cylinder.

7. A method for assembling a connector comprising:

attaching front ends of conductors of wires to rear ends of each of a plurality of longitudinally-elongated contacts, while allowing the wires to trail longitudinally rearwardly from said contacts;

moving each contact and a portion of the wire that trails rearward of the contact, perpendicular to the longitudinal axis of a slot corresponding in an insulative retainer, through a longitudinally-elongated opening in the slot and into the slot;

moving the retainer forwardly between upper and lower arms of a rear portion of an insulative body while moving front ends of the contacts into passages in a front portion of the body;

inserting the body with the retainer between its arms, forwardly into a shell and causing the shell to closely hold said arms together around said retainer.

8. A connector comprising:

an insulative retainer that has longitudinally-spaced front and rear ends and a plurality of elongated slots that each extends between said ends;

an insulative body that has front and rear portions, said body rear portion forming a rearwardly-opening cavity which receives said retainer, and said body front portion having a plurality of longitudinally-extending passages that are each aligned with one of said retainer slots;

a plurality of contacts that each has a rear portion that lies in one of said slots and a front portion that projects forward of the retainer and into one of said passages of said body front portion;

a plurality of insulated wires that each has a conductor and an insulator around the conductor, the conductor being terminated to one of said contact rear portions, and each insulated wire extending rearwardly within one of said slots and rearward of said retainer;

a metal shell, said body with said retainer in said body cavity lying in said shell and said shell having a rear portion extending rearward of said retainer; and wherein said insulated wires are part of a cable that includes said wires, said cable including a conductive shield around said wires and an outer jacket around said shield; and including a crimp barrel that lies around said wires, a front portion of said shield being wrapped backward around the outside of said crimp barrel, and said metal shell rear portion is crimped around said shield and barrel.

9. A connector comprising:

an insulative retainer which has front and rear ends and a plurality of longitudinally-extending slots with openings that each extends along the length of each slot wherein each opening provides access to the slot from outside the retainer;

an insulative body with an axis, said body having a front portion with a radially outer surface, said body front portion forming a plurality of passages that are separated from each other and from said radially outer surface, said body having a rear portion with a rearwardly-opening cavity that closely receives said retainer only in an orientation wherein said slots are aligned with said passages;

said body rear portion is divided into top and bottom arms with arm front ends that are joined to said body front portion and with the rest of each arm being free to deflect toward and away from the other arm;

said retainer has top and bottom surfaces, and has two of said slots in each of said surfaces, said arms being formed to closely receive said retainer between them, and said arms and retainer forming latches that retain said retainer in said cavity.

10. A connector comprising:

an insulative retainer which has front and rear ends and a plurality of longitudinally-extending slots with openings that each extends along the length of each slot wherein each opening provides access to the slot from outside the retainer;

an insulative body with an axis, said body having a front portion with a radially outer surface, said body front portion forming a plurality of passages that are separated from each other and from said radially outer surface, said body having a rear portion with a rearwardly-opening cavity that closely receives said retainer only in an orientation wherein said slots are aligned with said passages, wherein said body rear portion has an outer surface that lies on the surface of an imaginary cylinder;

said retainer has laterally opposite sides with surfaces that lie on said imaginary cylinder, and including a shell that has an inner surface that lies on the surface of said imaginary cylinder and that closely surrounds said body rear portion and said retainer.

11. A connector comprising:

an insulative retainer that has longitudinally-spaced front and rear ends and a plurality of elongated slots that each extends between said ends;

an insulative body that has front and rear portions, said body rear portion forming a rearwardly-opening cavity which receives said retainer, and said body front portion having a plurality of longitudinally-extending passages that are each aligned with one of said retainer slots;

a plurality of contacts that each has a rear portion that lies in one of said slots and a front portion that projects forward of the retainer and into one of said passages of said front body portion;

a plurality of insulated wires that each has a conductor and an insulator around the conductor, the conductor being terminated to one of said contact rear portions, and each insulated wire extending rearwardly within one of said slots and rearward of said retainer;

each of said slots has a longitudinally-extending axis and has slot walls forming a cross-section taken along said axis, each of said slot walls extends at least 220° but less than 360° of a circle, to form an undercut slot and leave a narrow opening of no more than about 140°;

each of said wires has a deformable plastic insulator of round cross-section that can be pushed radially through the narrow opening of the slot.

* * * * *